US010695768B2

(12) United States Patent
Dallimore et al.

(10) Patent No.: US 10,695,768 B2
(45) **Date of Patent: *Jun. 30, 2020**

(54) HAMMER FOR A HORIZONTAL SHAFT IMPACT CRUSHER

(71) Applicant: SANDVIK INTELLECTUAL PROPERTY AB, Sandviken (SE)

(72) Inventors: Rowan Dallimore, Bath (GB); Knut Kjaerran, Svedala (SE); Andreas Forsberg, Malmo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 606 days.

This patent is subject to a terminal disclaimer.

(21) Appl. No.: 15/319,794

(22) PCT Filed: Jun. 19, 2014

(86) PCT No.: PCT/EP2014/062967

§ 371 (c)(1),
(2) Date: Dec. 18, 2016

(87) PCT Pub. No.: WO2015/192908

PCT Pub. Date: Dec. 23, 2015

(65) Prior Publication Data

US 2017/0151572 A1 Jun. 1, 2017

(51) Int. Cl.

| | |
|---|---|
| ***B02C 13/28*** | (2006.01) |
| ***B02C 13/31*** | (2006.01) |
| ***B22D 19/06*** | (2006.01) |
| ***B22D 25/02*** | (2006.01) |
| *B02C 13/26* | (2006.01) |

(52) U.S. Cl.
CPC ..... *B02C 13/2804* (2013.01); *B02C 13/31* (2013.01); *B22D 19/06* (2013.01); *B22D 25/02* (2013.01); *B02C 2013/29* (2013.01)

(58) Field of Classification Search
CPC ... B02C 13/804; B02C 13/31; B02C 2013/29; B22D 19/06; B22D 25/02
See application file for complete search history.

(56) References Cited

U.S. PATENT DOCUMENTS

| | | | | |
|---|---|---|---|---|
| 5,005,772 | A | 4/1991 | Ostergaard | |
| 9,908,121 | B2 * | 3/2018 | Forsberg | B02C 13/26 |
| 2011/0204172 | A1 * | 8/2011 | Orphall | B02C 13/2804 241/291 |
| 2012/0043403 | A1 * | 2/2012 | Roozeboom | B02C 13/06 241/25 |
| 2013/0161428 | A1 * | 6/2013 | Hongo | B02C 13/2804 241/73 |

(Continued)

FOREIGN PATENT DOCUMENTS

| | | |
|---|---|---|
| FR | 2263820 A1 | 10/1975 |
| GB | 2110113 A | 6/1983 |

(Continued)

*Primary Examiner* — Omar Flores Sanchez
(74) *Attorney, Agent, or Firm* — Corinne R. Gorski

(57) ABSTRACT

A hammer mountable at a rotor of a horizontal shaft impact crusher (HSi-crusher), the hammer including a front face, a rear face and at least one recess projecting inwardly into a main body of the hammer from the front face. The at least one recess being arranged to receive an attachment element to mount the hammer at a hammer lifting device.

9 Claims, 5 Drawing Sheets

(56) References Cited

U.S. PATENT DOCUMENTS

| | | | | |
|---|---|---|---|---|
| 2013/0277476 | A1* | 10/2013 | Doppstadt | B02C 13/28 241/197 |
| 2015/0360230 | A1* | 12/2015 | Fredsall | B02C 18/145 241/300 |
| 2016/0129451 | A1* | 5/2016 | Dallimore | B02C 13/095 241/189.1 |

FOREIGN PATENT DOCUMENTS

| | | | |
|---|---|---|---|
| WO | 2010071550 | A2 | 6/2010 |
| WO | 2011129742 | A1 | 10/2011 |
| WO | 2011129744 | A1 | 10/2011 |
| WO | 2013189687 | A1 | 5/2013 |
| WO | 2013189691 | A1 | 12/2013 |

* cited by examiner

HAMMER FOR A HORIZONTAL SHAFT IMPACT CRUSHER

FIELD OF INVENTION

The present invention relates to a rotor hammer and a method of manufacturing the same, and in particular although not exclusively, to a hammer having a recess extending into its main body from a front face for mounting to a hammer lifting device.

BACKGROUND ART

Horizontal shaft impact crushers (HSi-crushers) are utilized in many applications for crushing hard material, such as pieces of rock, ore etc. A HSi-crusher comprises a crushing chamber housing an impeller (alternatively termed a rotor) that is driven to rotate about a horizontal axis. Pieces of rock are fed towards the impeller and are struck by impeller mounted hammer elements. The rock pieces are disintegrated initially by striking contact with the hammer elements and are then accelerated and thrown against breaker plates (typically referred to as curtains) to provide further disintegration. The action of the impeller causes the material fed to the horizontal shaft impact crusher to move freely in the chamber and to be crushed upon impact against the hammer elements, against the curtains, and against other pieces of material moving around at high speed within the chamber. Example HSi-crushers are described in WO 2010/071550; WO 2011/129744; WO 2011/129742; WO 2013/189691 and WO 2013/189687.

Conventionally, the hammer wear parts are interchanged at the impeller via lifting engagers that are brought into position horizontally at the sides of each hammer. Such an arrangement is often problematic as access to the sides of the elongate hammers is restricted. Additionally, due to the appreciable size and weight of the hammer elements interchange at the impeller carries significant health and safety risks as it is typically required to manually manipulate the hammers into or from their impeller mounted position. Accordingly it is not uncommon for operator fingers to become trapped during installation and removal. What is required therefore is a hammer part that may be conveniently mounted at a lifting tool that addresses the above problems.

SUMMARY OF THE INVENTION

It is an objective of the present invention to facilitate mounting and dismounting crusher hammer elements at an impeller of a HSi-crusher. It is a further specific objective to provide a hammer mountable at a rotor of a HSi-crusher that is capable of being mounted and suspended from a lifting device and/or auxiliary lifting tool such as a crane and the like to enable the hammer to be manipulated and in particular rotated at a suitable lifting device during mounting and dismounting procedures. It is a further objective to reduce and eliminate, as far as possible, the health and safety risks to which operating personnel are exposed during hammer mounting and dismounting procedures so as to avoid specifically injuries to an operator's hands and fingers. It is yet a further objective to enable hammer parts to be raised and lowered substantially vertically at a HSi-crusher to avoid or minimise a need for access to the lateral sides of the crusher during such procedures.

The objectives are achieved via a hammer that is configured specifically for mounting at a lifting device via contact with a front face of the hammer. Advantageously, the hammer comprises at least one bore to receive an attachment, optionally in the form of threaded bolt, to couple the hammer releasably to the lifting device. Suspending the hammer at the lifting device via its front face is beneficial to greatly facilitate mounting and dismounting the hammer at the rotor where access and available space is typically restricted. Additionally, the present hammer is capable of being supported from a position vertically above by the lifting device as the locking wedges are moved into either engaging or disengaging contact with the hammer at the rotor. This is achieved specifically by attachment to the lifting device via the hammer front face. Once the hammer is secured via the locking wedges, the lifting device may be conveniently disengaged from the hammer. Accordingly, the present hammer configuration avoids the need for personnel to physically hold the hammer in position as the locking wedges are either engaged or disengaged. The risk of trapping an operator's hands or fingers is therefore greatly reduced or eliminated.

Advantageously, the present hammer is conveniently and reliably attachable to a lifting device such that the hammer part, once attached, may be held and rotated in a suspended 'floating' position such that an operator may manipulate conveniently the hammer part and rotated it about an axis aligned transverse or perpendicular to the vertical (upward and downward) lifting direction by which the hammer part is introduced to or removed from the crusher rotor.

According to a first aspect of the present invention there is provided a hammer mountable at a rotor of a horizontal shaft impact crusher, the hammer comprising: a main body having a length defined and terminated by length ends and a width defined and terminated by lengthwise extending sides; a front face of the main body intended to be forward facing with a rotational direction of the rotor and a rear face of the main body intended to be rearward facing opposed to the rotational direction of the rotor; a lengthwise extending edge of each of the lengthwise extending sides defining a part of a perimeter of the front face and representing a leading edge to contact and break material fed into the crusher; characterised by: at least one recess extending into the main body from the front face to receive an attachment element to mount the hammer at a hammer lifting device.

Reference within this specification to the main body 'front face' encompasses the exposed surface at the front face side of the main body and includes specifically an exposed surface of one or more mount projections extending outwardly from a front face side of the main body.

The present hammer may comprise one or a plurality of recesses extending into the main body from the front face. The recesses may comprise a variety of different depths and shape configurations and in particular cross sectional profiles. Optionally, the cross sectional profile shape of the recess (in a plane of the main body) is circular such that the recess comprises a generally cylindrical cavity shape profile. The recess may also optionally comprise one or more angled sections to allow an attachment device or elements to be inserted into the recess and moved laterally (in the widthwise and/or lengthwise directions of the hammer) to provide locking engagement. The recess may therefore comprise a channel, part-channel or groove like configuration for releasable mating with a corresponding lug or other attachment element such as a bayonet, pin, rod, screw or the like.

Preferably, the at least one recess comprises threads to receive and cooperate with a threaded shaft of an attachment bolt. Preferably, the threads extend over the full depth of the recess being formed on the inward facing surface that defines the wall of the recess being generally cylindrical. Such an arrangement is advantageous to cooperate with a conventional threaded shaft of, for example, an attachment bolt.

Preferably, the front face is generally concave and the rear face is generally convex. Such an arrangement optimises the crushing characteristics of the hammer during use.

Optionally, the hammer further comprises a mount projection extending outwardly from a front face side of the main body, the at least one recess extending into the mount projection. Optionally, the mount projection is substantially rectangular and extends lengthwise between the length ends of the main body. The mount projection facilitates mounting and dismounting of the hammer at a lifting device by providing a raised plateau region having a substantially planar contact face that may be mated in close touching contact with a corresponding flat or planar mount face of a lifting device attachment bracket.

Optionally, a depth of the at least one recess is substantially equal to a thickness by which the mount projection extends outwardly from the main body. Such an arrangement is beneficial so as to not affect or weaken the main body. Optionally, a depth of the projection is less than a corresponding thickness of the main body (between the front and rear face to one lateral side of the projection). Optionally, the projection comprises a depth in a range 5 to 30%, 5 to 25% and more preferably 10 to 20% of a thickness of the main body being defined by a distance between the front and rear face of the main body at each length end.

Preferably, the hammer further comprises at least one insert embedded to extend inwardly from the front face of the main body, the insert comprising the at least one recess. Preferably, the insert is formed integrally with the main body as the main body is cast formed. The present hammer is preferably formed from a casting process in which a flowable metal is introduced into a mould and allowed to solidify. The inserts may be conveniently supported within the mould during introduction and settling of the flowable metal so as to be locked and formed integrally within the cast main body. Advantageously only an end surface of the insert is exposed in the resulting as-formed cast hammer such that the inserts are effectively fused to the main body and extend inwardly into the main body (or projection) from the front face. Optionally, the insert comprises a flange that extends radially outward from a main body of the insert. The flange may comprise one or a plurality of arms (e.g., two) extending from the insert main stem. This flange is advantageous to ensure that the insert is held firmly by the metal which solidifies around it such that when pressure is applied in use (i.e., via the tightening of attachment bolts) the insert cannot move axially or radially within the casting.

Preferably, the hammer comprises a plurality of recesses extending inwardly from the front face. In particular, the hammer comprises at least two recesses and in particular two threaded bores projecting inwardly into the main body (encompassing a main body projection) from the front face. Preferably, the hammer comprises a pair of recesses spaced apart in a lengthwise direction between the length ends and extending into the main body from the front face.

According to a second aspect of the present invention there is provided a method of casting a hammer mountable at a rotor of a horizontal shaft impact crusher, the method comprising: mounting an insert within a mould so that one face of the insert is exposed to be outward facing from the mould; filling the mould with a flowable metal such that the face of the insert is exposed from the metal; allowing the metal to solidify within the mould to set the insert within the mould and to define a main body; the main body comprising a length terminated by length ends and a width defined and terminated by lengthwise extending sides, the main body also having a front face intended to be forward facing with a rotational direction of the rotor and rear face intended to be rearward facing opposed to the rotational direction of the rotor, a lengthwise extending edge of each of the lengthwise extending sides defining a part of a perimeter of the front face and representing a leading edge to contact and break material fed into the crusher; wherein the insert comprises a recess extending inwardly from the front face.

Preferably, the hammer is formed by a sand mould casting process in which a sand, and optionally a suitable bonding agent (such as clay) is mixed or is present within the sand, to form the mould and into which the flowable metal may be poured. As will be appreciated, the sand may be typically contained within a framework or suitable flask enclosure.

Optionally, the method further comprises mounting a plurality of inserts within the mould to provide a plurality of recesses extending inwardly from the front face. Optionally, each of the inserts may comprise threads to receive and cooperate with a threaded shaft of an attachment bolt. Optionally, the main body (encompassing a mount projection) is formed from a Chrome based metal and the insert is formed from the same or a different material to the main body.

Optionally, the threads are formed at the insert prior to the step of mounting the insert within the mould. Alternatively, the threads may be formed at the insert after the step of allowing the metal to solidify within the mould.

According to a further aspect of the present invention there is provided an assembly attachable to an auxiliary lifting tool, the assembly comprising a hammer mountable at a rotor of a HSi-crusher and a lifting device suitable to be raised and lowered into the chamber of the crusher and to raise and lower the hammer relative to the rotor.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
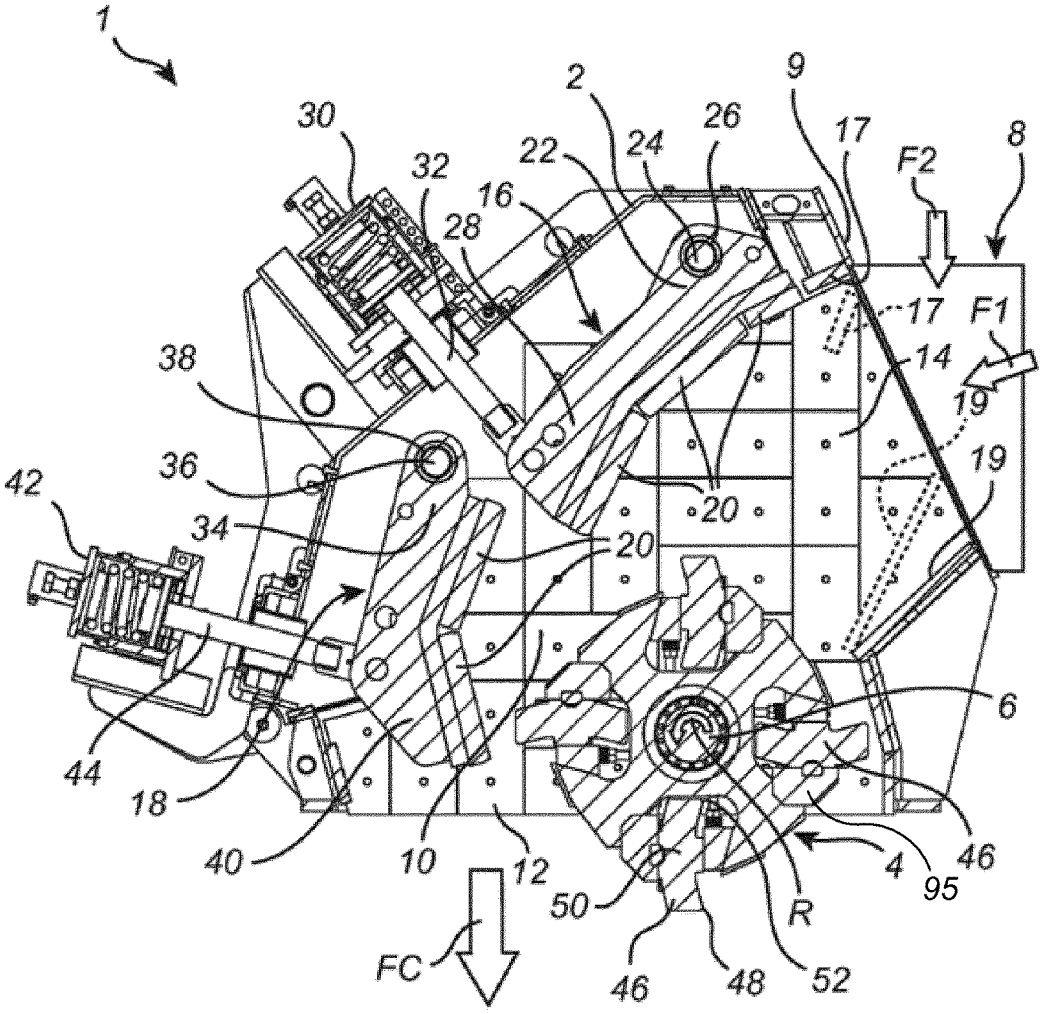
FIG. 1 is cross-sectional side view of a horizontal shaft impact crusher comprising a plurality of replaceable hammer elements releasably engageable with a lifting device according to a specific implementation of the present invention.

Referring to FIG. 1 a horizontal shaft impact crusher 1 (HSi-crusher) comprises a housing 2 in which an impeller indicated generally by reference 4 is rotatably mounted. A motor, (not illustrated) is operative for rotating a horizontal shaft 6 on which the impeller 4 is mounted. As an alternative to impeller 4 being fixed to shaft 6, impeller 4 may rotate around shaft 6. In either case, impeller 4 is operative for rotating around a horizontal axis, coaxial with the centre of shaft 6.

Material to be crushed is fed to a feed chute 8, which is mounted to an inlet flange 9 of housing 2, and enters a crushing chamber 10 positioned inside the housing 2 and at least partly enclosing impeller 4. Material crushed within the crusher 1 exits the crushing chamber 10 via a crushed material outlet 12. Housing 2 is provided with a plurality of interior wear protection plates 14 operative for protecting the interior of crushing chamber 10 from abrasion and impact by the material to be crushed.

Crusher 1 comprises a first curtain 16, and a second curtain 18 arranged inside crushing chamber 10. Each curtain 16, 18 comprises at least one wear plate 20 against which material may be crushed. A first end 22 of first curtain 16 is mounted via a horizontal first pivot shaft 24 extending through an opening 26 formed in curtain 16 at the first end 22. First pivot shaft 24 extends further through openings in the housing 2 to suspend the first end 22 in the housing 2. A second end 28 of first curtain 16 is connected to a first adjustment device 30 comprising at least one adjustment bar 32. A first end 34 of second curtain 18 is mounted by means of a horizontal second pivot shaft 36 extending through an opening 38 formed in curtain 18 at first end 34. Second pivot shaft 36 extends further through openings in the housing 2 to suspend the first end 34 in the housing 2. A second end 40 of second curtain 18 is similarly connected to a second adjustment device 42 comprising at least one adjustment bar 44.

Impeller 4 is provided with four hammer elements 46 according to the specific embodiment, with each element 46 having a generally curved or 'banana'-like shape profile, when view in cross-section. An arrow R indicates the rotational direction of impeller 4. A leading edge 48 of each respective hammer element 46 extends in the direction of rotation R. Prior to extended use, hammer element 46 is symmetric around a central portion 50. However, once leading edge 48 has been worn element 46 can be turned and mounted with its second leading edge 52 operative for crushing material.

The HSi-crusher 1 can be adjusted to a first crushing setting, which for example may be a primary crushing setting, for crushing large objects (typically having a maximum particle size of 300-1200 mm), and a second (or secondary) crushing setting being different from the first setting for crushing intermediate size objects (having a maximum particle size of less than 400 mm and typically 20-400 mm). When crusher 1 is operated in the primary setting the crushed material exiting crusher 1 via the outlet 12 would typically have an average particle size of 35-300 mm, and typically at least 75% by weight of the crushed material would have a particle size of 20 mm or larger. When crusher 1 is operated in the secondary setting the crushed material leaving the crusher 1 via the outlet 12 would typically have an average particle size of 5 to 100 mm, and typically at least 75% by weight of the crushed material would have a particle size of 5 mm or larger. Within the present specification the 'average particle size' refers to weight based average particle size.

Adjusting crusher 1 to the primary crushing setting would typically involve retracting the first and/or second curtains 16, 18 away from impeller 4, to form a crushing chamber 10 having a large volume and a large distance between the impeller 4 and the wear plates 20 of curtains 16, 18. Such retraction of at least one curtain 16, 18 would be performed by operating the first and/or second adjustment devices 30, 42, which may typically involve hydraulic cylinders and/or mechanical adjustment devices using threaded bars. Adjusting the crusher 1 to the secondary crushing setting would, on the other hand, typically involve moving the first and/or second curtains 16, 18 towards the impeller 4 by means of operating the first and/or second adjustment devices 30, 42, to create a crushing chamber 10 having a small volume and a short distance between the impeller 4 and the wear curtain plates 20. In addition to adjusting the position of the curtains 16, 18, the horizontal shaft impact crusher feed chute 8 is adjusted to feed the material into the crushing chamber 10 in a first direction F1 when crusher 1 is adjusted to the primary setting, and in a second direction F2 when crusher 1 is adjusted to the secondary setting. Hence, the first crushing setting is different from the second crushing setting. Furthermore, the first direction F1 of feeding material to the crusher 1 is different from the second direction F2 of feeding material to the crusher 1.

The adjustment of the HSi-crusher 1 from a primary crushing setting to a secondary crushing setting may also involve adjusting the positions of an upper feed plate 17 and a lower feed plate 19 that are located just inside of the inlet flange 9 of the housing 2 of the crusher 1. The feed plates 17, 19 protect the inlet of the housing 2, and provide the material fed to housing 2 with a desired direction. In FIG. 1, the upper and lower feed plates 17, 19 are adjusted to the primary setting (shown in unbroken lines) with the intention of directing the coarse material towards impeller 4 and the first curtain 16 when the crusher 1 operates in the primary setting. The positions of the upper and lower feed plates 17, 19 in the secondary setting are indicated with broken lines in FIG. 1. As can be seen the upper and lower feed plates 17, 19 are, in the secondary setting, arranged for directing the material directly towards the impeller 4. In this manner, the rather fine material fed when the crusher 1 operates in the secondary setting will receive more 'hits' from the impeller hammer elements 46 leading to a greater reduction in the size of the material.

In operation material to be crushed is fed to the feed chute 8 and further into the crushing chamber 10, either in the direction F1 if the crusher 1 is adjusted to the primary setting or in the direction F2 if crusher 1 is adjusted to the secondary setting. The material will first reach that part of the crushing chamber 10 which is located adjacent to first curtain 16, being located upstream of the second curtain 18 as seen with respect to the direction of travel of the material. Impeller 4 is rotated at typically 400-850 rpm. When the material is impacted by the impeller elements 46 it will be crushed and accelerated against wear plates 20 of first curtain 16 where subsequent and further crushing occurs. The material will bounce back from first curtain 16 and will be crushed further against material travelling in the opposite direction and then again against the elements 46. When the material has been crushed to a sufficiently small size it will move further down the crushing chamber 10, and will be accelerated, by means of the elements 46, towards wear plates 20 of the second curtain 18, being located downstream of first curtain 16. When the material has been crushed to a sufficiently small size it exits chamber 10 via outlet 12 as a flow of crushed material FC.

Figure 2:
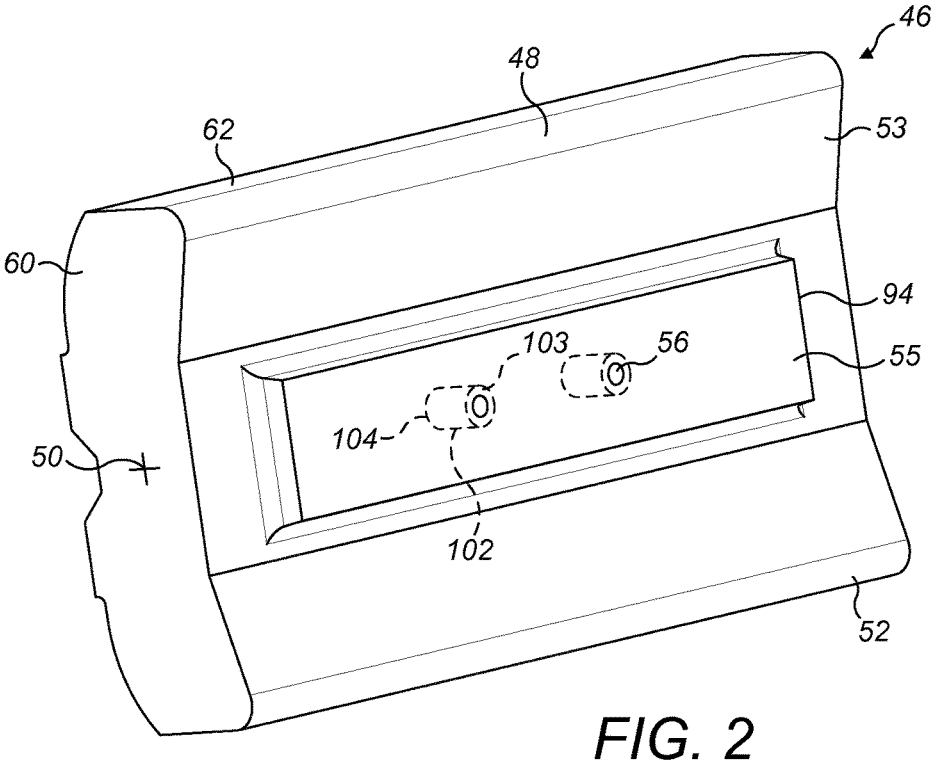
FIG. 2 is a perspective front view of a replaceable hammer element of FIG. 1.
Figure 3:
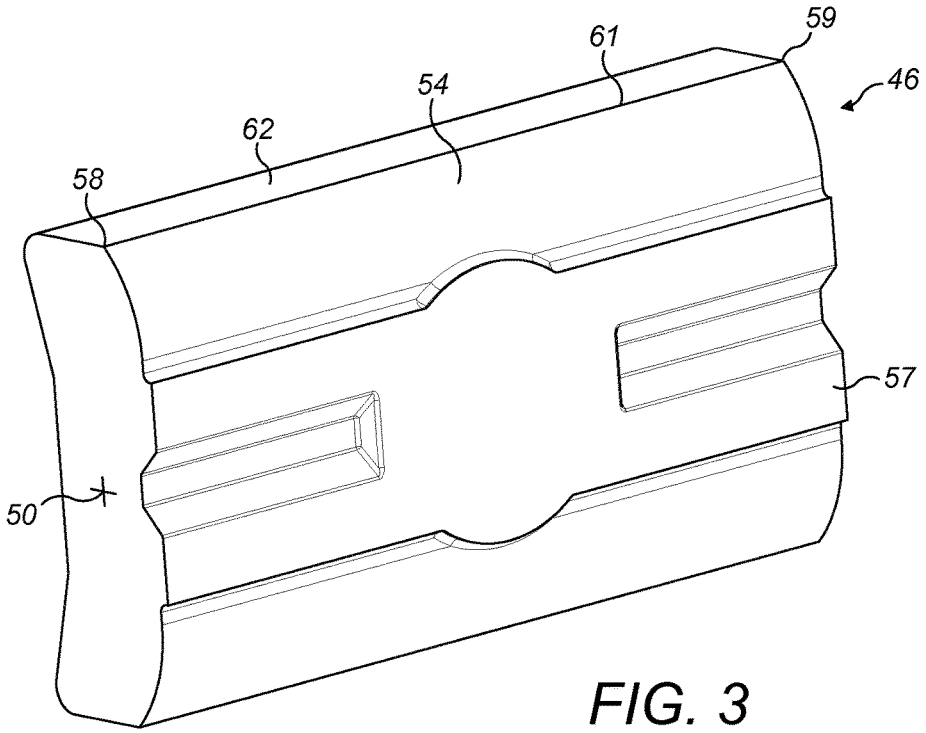
FIG. 3 is a rear perspective view of the hammer element of FIG. 2.

Referring to FIGS. 2 and 3, each hammer element 46 comprises a generally rectangular main body having a main length defined by and extending between a first end 58 and a second end 59. A pair of ends faces 60 extend widthwise at ends 58, 59. The pair of material contact edges 48 and 52 extend lengthwise between end faces 60. Accordingly, element 46 comprises a front face 53 configured for positioning with the rotational direction of impeller 4 so as to represent a leading face. Element 46 further comprises a rear face 54 positioned opposed to the rotational direction of impeller 4 so as to represent a trailing face of element 46. To optimise the crushing performance of element 46, front face 53 is generally concave whilst rear face 54 is generally convex. Accordingly, leading edge 48 represents a forwardmost part of face 53 when element 46 is mounted at impeller 4 via locking wedges 95. Each respective leading edge 48, 52 is generally curved (or rounded) and defines a leading edge of a pair of lengthwise extending side faces 62 with an adjacent trailing edge indicated generally by reference 61.

A generally rectangular mounting projection 94 is positioned at a mid-width position of front face 53 and extends in a lengthwise direction between ends 58, 59. Projection 94 terminates at an exposed substantially rectangular contact surface 55 that is positioned approximately co-planar with each leading edge 48, 52. A pair of threaded bores extend into projection 94 with each bore 56 spaced apart in the lengthwise direction and aligned at the same widthwise position so as to be generally central within contact surface 55.

Rear face 54 also comprises a plurality of raised ridges indicated generally by reference 57 resultant from the casting of element 46 involving the use of 'runners' and 'risers' as will be appreciated by those skilled in the art.

Each recess 56 is formed within a respective insert 102 that is cast integrally with the main body of hammer 46 during a sand casting process. That is, according to a preferred method of manufacture, each insert 102 is positioned within a suitable sand based mould retained within a flask using appropriate runners and risers. A chrome based flowable metal is then introduced into the mould to surround inserts 102 and then allowed cool and solidify so as to lock and fuse inserts 102 within the main body of hammer 46. Each insert 102 comprises a front face 103 a rear face 104. Rear face 104 is positioned to be downward facing into the mould during casting whilst front face 103 is aligned approximately coplanar with leading edge 58 so as to remain exposed once the chrome metal has set. That is, each insert front face 103 is positioned coplanar with contact face 55 whilst rear face 104 is embedded within projection 94 and/or the hammer main body.

To facilitate manufacture, each insert 102 is drilled or machined to form each respective recess 56 prior to each insert 102 being introduced into the mould prior to casting. However, according to further specific implementations, each bore 56 may be formed aft casting hammer 46 with inserts 102 being integrally formed therein.

A lifting device 63, suitable to releasable mount the hammer 46, comprises an elongate main body 64 formed from a generally hollow bar having a first end 65 and a second end 66. Main body 64 comprises a first side 88 and a second side 89 positioned at either side of a longitudinal axis 96 extending centrally through main body 64. A fin 67 projects laterally from second side 89 and comprises an eyelet 68 positioned at an outward end 101 of fin 67. A second fin end 69 is mounted at main body 64 via an elongate groove 70 extending axially through main body 64 and having a depth sufficient to accommodate fin end 69. Fin 67 is secured rigidly to main body 64 via welding or suitable attachment pins or bolts (not shown). An axle 80 is rotatably mounted at an axle mounting 87 provided at main body second end 66. Axle 80 extends laterally from both sides 88, 89 to provide a mount for a flange 77 positioned at first side 88 and an attachment bracket 83 positioned at main body second side 89. Flange 77 is rigidly mounted to axle 80 via an axle mount 81 with coupling provided by a mounting bolt 82. Flange 77 comprises a generally disc-like configuration being generally planar with an oval shape profile. A pair of notches or recesses 78, 79 extend radially inward from a perimeter 90 of flange 77. Notches 78, 79 are positioned diametrically opposite one another at respective 'twelve o'clock and six o'clock' positions.

Attachment bracket 83 also comprises a plate-like body having a generally planar configuration. Bracket 83 is generally rectangular with a rearward face of bracket 83 attached rigidly to one end of axle 80 via an axle mount 86 so as to present an outward facing mount face 100 for positioning against hammer contact face 55. Accordingly, mount 86 and bracket 83 are configured for rotation about an axis 97 extending centrally through axle 80. Flange 77, being mounted at one end of axle 80, is rotatably locked with hammer attachment bracket 83 with both components rotatably mounted with respect to main body 64 about rotational axis 97. Accordingly, rotation of flange 77 about axis 97 provides a corresponding rotation of bracket 83 about axis 97.

Bracket 83 comprises a first pair of mount holes 85 spaced apart in a lengthwise direction at bracket 83 between respective lengthwise end edges 98. A second pair of mount holes 91 are also spaced apart in the lengthwise direction between bracket end edges 98 with the first and second pairs of holes 85, 91 spaced apart in the widthwise direction between bracket widthwise end edges 99. Holes 85 are positioned approximately mid-width between widthwise end edge 99 whilst the second pair of holes 91 are positioned closer to one of the widthwise end edges 99 so as to be positioned between the first pair of holes 85 and one end edge 99.

Figure 4:
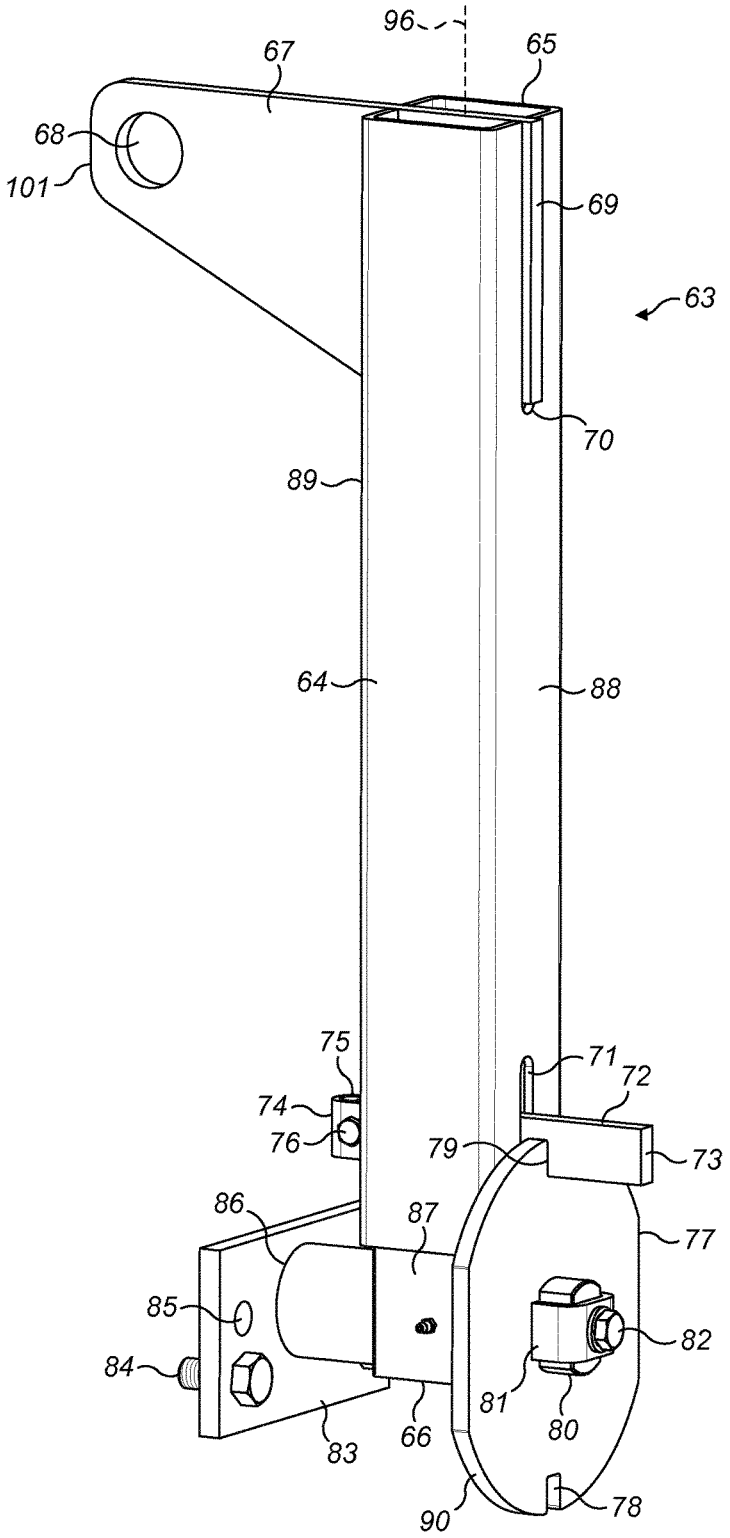
FIG. 4 is a perspective view of a lifting device to allow raising and lowering of the hammer element of FIG. 6 according to a specific implementation of the present invention.
Figure 5:
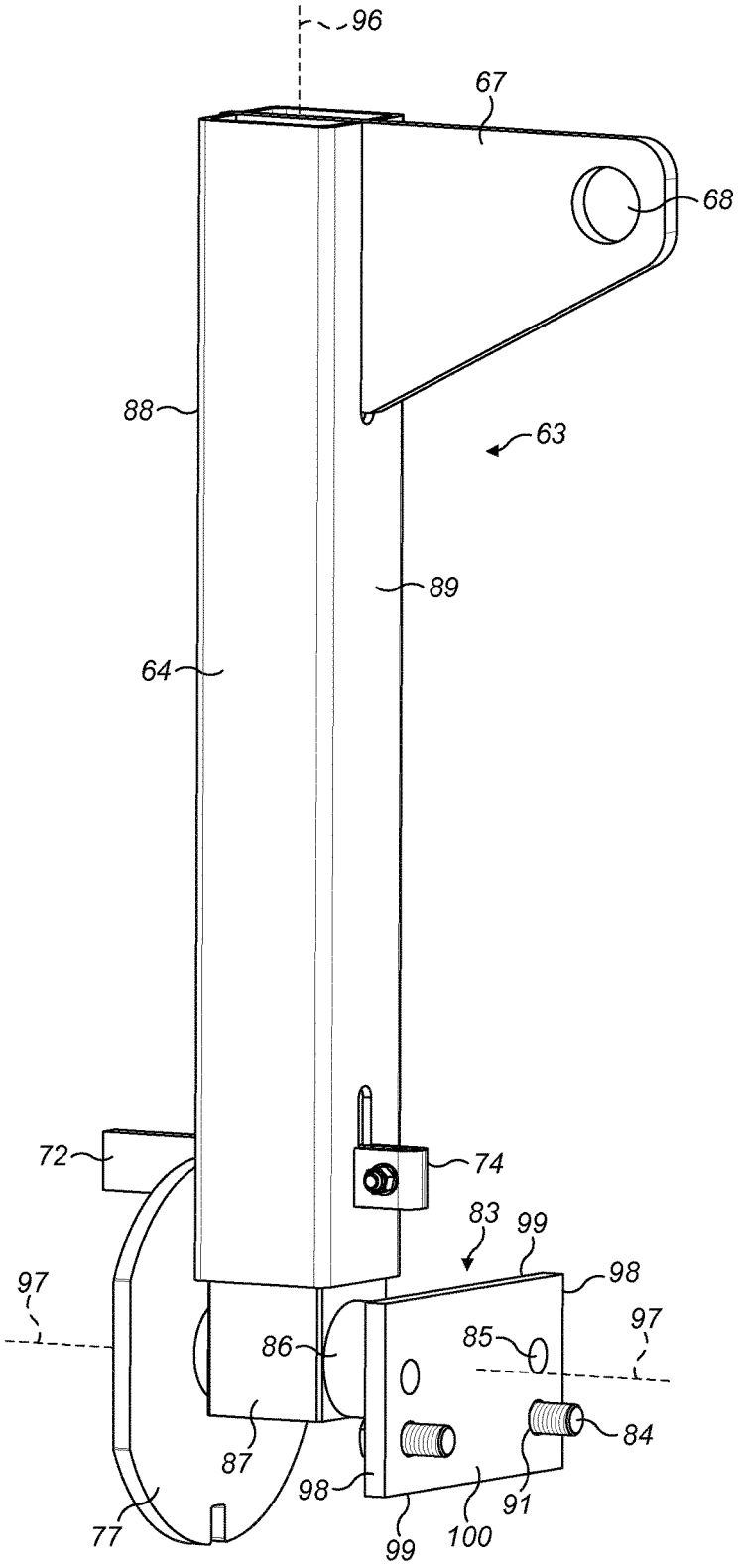
FIG. 5 is further perspective view of the lifting device of FIG. 4.

Main body 64 further comprises an elongate slot 71 extending a short axial distance through sides 88 and 89. A locking lever 72 extends through main body 64 being aligned transverse (including perpendicular) to axis 96 so as to be aligned generally with axle axis 97. Lever 72 projects through slot 71 so as to extend laterally outward from both sides 88, 89. A first lever end 75 is mounted at main body 64 via a pivot mount 74 and a pivot pin 76 extending through mount 74 and lever end 75. Accordingly, a second lever end 73 is capable of pivoting about pin 76 to be moved in the axial direction of main body 64 within slot 71 towards and away from flange 77. In particular, lever 72 is mounted axially to one side of flange 77 such that in a lowered engagement position of FIG. 4, a part of lever 72 is configured for positioning to be received within one of the notches 79. With lever 72 positioned accordingly, flange 77 is rotatably locked at axis 97. Accordingly, attachment bracket 83 is also rotatably locked at main body 64. Lever end 73 may be grasped by a user and raised in a direction of axis 96 so as to free notch 79 and allow flange 77 to be rotated to provide a corresponding rotation of bracket 83 about axis 97.

Figure 6:
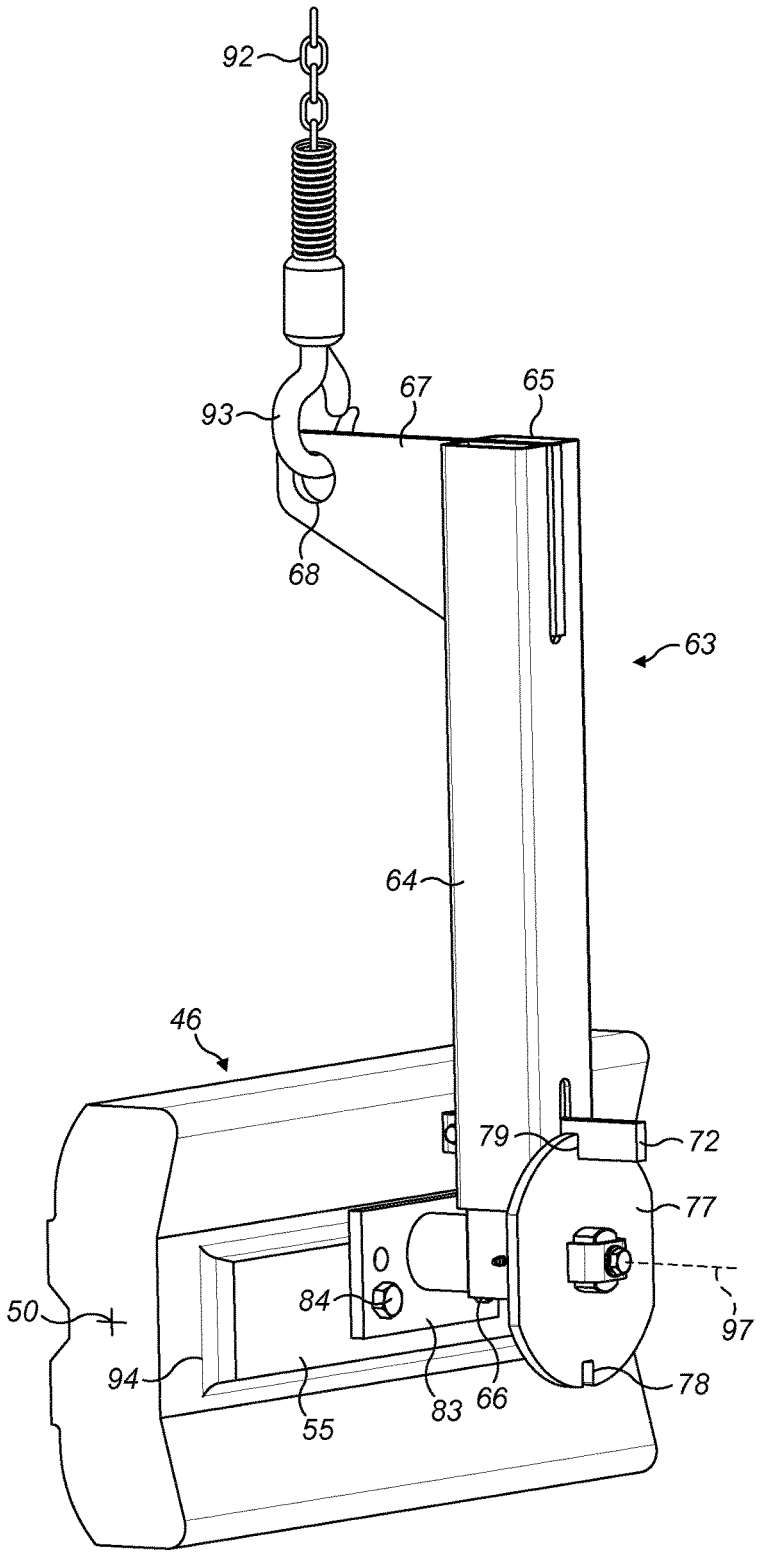
FIG. 6 is a perspective view of the lifting device of FIG. 5 suspended from an auxiliary lifting tool and mounting the hammer element of FIG. 3 according to a specific implementation of the present invention.

FIG. 6 illustrates lifting device 63 suspended from a chain 92 of an auxiliary lifting tool such as a crane (not shown). A lowermost end of chain 92 comprises an attachment coupling 93 configured to engage eyelet 68 and suspend device 63 from the lifting crane. Hammer element 46 is demountably attachable to lifting device 63 via attachment bracket 83 engaging the contact surface 55 of mount projection 94. In particular, element 46 is releasably secured to device 63 via a pair of mounting bolts 84 provided through one of the pairs of holes 85, 91 that engage into the hammer bores 56 as hammer element 46 is mated against bracket mount face 100. FIG. 6 illustrates the mounting of a non-symmetrical element 46 via the second pair of holes 91 that are positioned off-centre (in the widthwise direction) of bracket 83. Each bolt 84 is mated into the respective threaded bore 56 so as to releasably secure element 46 to device 63.

A length of axle mount 86 in a direction of axis 97 is configured such that element 46 is suspended on an axis extending through chain 92 (that bisecting eyelet 68) such that the elongate tubular main length 64 is suspended substantially vertically. Element 46 is held below coupling 93 and fin 67 by substantially the full length of main body 64 so as to allow unhindered rotation of element 46 about axis 97 when suspended from the auxiliary lifting tool. That is, with lever 72 raised to a non-engaging position within slot 71, a user may grasp flange 77 so as to rotate it about axis 97 providing a corresponding rotation of element 46 about axis 97. Element 46 may be locked in two different rotational positions corresponding to the engagement of each respective notch 78, 79 by lever 72.

So as to ensure the mass centre of element 46 is generally coaxial with axis 97, element 46 may be mounted at different positions relative to device 63 via the use of either set of bolt mounting holes 85, 91.

The invention claimed is:

1. A hammer mountable at a rotor of a horizontal shaft impact crusher, the hammer comprising:

a main body having a length defined and terminated by length ends and a width defined and terminated by lengthwise extending sides;

a front face of the main body intended being forward facing with a rotational direction of the rotor and a rear face of the main body being rearward facing and opposed to the rotational direction of the rotor;

a lengthwise extending edge of each of the lengthwise extending sides defining a part of a perimeter of the front face and representing a leading edge to contact and break material fed into the crusher;

at least one recess extending into the main body from the front face arranged to receive an attachment element to mount the hammer at a hammer lifting device; and at least one insert embedded to extend inwardly from the front face of the main body, the insert including the at least one recess.

2. The hammer as claimed in claim 1, wherein the at least one recess including threads to receive and cooperate with a threaded shaft of an attachment bolt.

3. The hammer as claimed in claim 1, wherein the front face is generally concave and the rear face is generally convex.

4. The hammer as claimed in claim 1, further comprising a mount projection extending outwardly from a front face side of the main body, the at least one recess extending into the mount projection.

5. The hammer as claimed in claim 4, wherein the mount projection is substantially rectangular and extends lengthwise between the length ends of the main body.

6. The hammer as claimed in claim 4, wherein a depth of the at least one recess is substantially equal to a thickness by which the mount projection extends outwardly from the main body.

7. The hammer as claimed in claim 1, wherein the insert is formed integrally with the main body as the main body is cast formed.

8. The hammer as claimed in claim 1, comprising a plurality of recesses extending inwardly from the front face.

9. The hammer as claimed claim 1, comprising a pair of recesses spaced apart in a lengthwise direction between the length ends and extending into the main body from the front face.

* * * * *